US007590367B2

(12) United States Patent
Blair et al.

(10) Patent No.: US 7,590,367 B2
(45) Date of Patent: Sep. 15, 2009

(54) CHARGE DEVICE COATINGS

(75) Inventors: Christopher David Blair, Webster, NY (US); Thomas Paul Debies, Webster, NY (US); Barry Ross Havens, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 325 days.

(21) Appl. No.: 11/469,984

(22) Filed: Sep. 5, 2006

(65) Prior Publication Data

US 2008/0056765 A1 Mar. 6, 2008

(51) Int. Cl.
*G03G 15/02* (2006.01)

(52) U.S. Cl. ..... 399/100; 399/170

(58) Field of Classification Search ..... 399/98, 399/100, 170, 172
See application file for complete search history.

(56) References Cited

U.S. PATENT DOCUMENTS

| | | | | |
|---|---|---|---|---|
| 4,086,650 | A | 4/1978 | Davis et al. | |
| 6,350,516 | B1 * | 2/2002 | Weber et al. | 428/332 |
| 7,050,743 | B2 | 5/2006 | Blair et al. | |
| 2005/0048294 | A1 * | 3/2005 | Kaplan et al. | 428/447 |

* cited by examiner

*Primary Examiner*—David M Gray
*Assistant Examiner*—Joseph S Wong
(74) *Attorney, Agent, or Firm*—Pepper Hamilton LLP

(57) ABSTRACT

An electrically conductive latex/antioxidant coating for a corona charging device that is capable of absorbing effluents created during the electrostatographic or xerographic process, a method for making the coating, and applying the coating are described herein.

21 Claims, 4 Drawing Sheets

CHARGE DEVICE COATINGS

BACKGROUND

1. Technical Field

The disclosed embodiments generally related to the field of electrostatic marking systems and corona charging components for these systems.

2. Description of the Related Art

In an electrostatographic process, a system is used hereby a uniform electrostatic charge is placed upon a reusable photoconductive surface. The charged photoconductive surface is then exposed to a light image of an original and the charge is selectively dissipated to form a latent electrostatic image of the original on the photoreceptor. The latent image is developed by depositing toner, finely divided marking and charged particles, upon the photoreceptor surface that become electrostatically attached to charged areas of the latent electrostatic image creating a visible replica of the original. The toned developed image is then transferred from the photoreceptor to a final image support material, such as, for example, paper, and fixed to the image support media by heat and pressure to form a permanent copy corresponding to the original.

In xerographic systems of this type, a photoreceptor surface may be arranged in a path through the various processing stations of the xerographic system. The photoconductive or photoreceptor surface may be reusable in that following transfer of the toner image to the support material several charging stations may be traversed that may expunge the photoreceptor surface of residual toner and prepare the photoreceptor to accept another latent electrostatic image for the reproduction of another original. For example, charging stations may be placed at positions where a uniform charge on the photoreceptor surface is necessary, such as, transfer stations, cleaning station, and the like.

A charging station may apply an electrostatic charge to a photoconductive or photoreceptor surface of a photoreceptor or photosensitive member using a number of methods such as, for example, electron-emitting pins, an electron-emitting grid, single corona-charging structures and single or multiple dicorotron wire assemblies. Corotrons, scorotrons, and dicorotrons, referred to herein collectively as "corotrons", are commonly used in the xerographic process and use high voltage electricity to create the "corona" which is discharged onto the photoreceptor surface to place a uniform charge on the surface of the photoreceptor.

A "corona" may be defined as a localized collection, or "cloud", of charged ions that may be influenced to move toward an oppositely charged target. Corotrons create a corona by placing a high direct current (DC) potential, which may be either positive or negatively charged, on a thin wire. In contrast, dicorotrons use an alternating current (AC) potential on a glass coated wire to create both positive and negative ions. The wire of a corotron makes up a corona-generating electrode that is typically highly conductive. The wire may be mounted in an elongated U-shaped housing between two insulating anchors called "insulators" which support and hold the wire in a singular plane within the housing. The corotron is, generally, located within close proximity to the photoreceptor surface, and a screen or shield with a DC bias, whose voltage may determine the polarity and amplitude of the charge placed on the photoreceptor, and may be used to direct the corotron's charge toward the photoreceptor.

A corona may contain any number of ions, for example, $H^{+}$ and $N_4^{+}$ which are the major positive ions for both AC and positive DC devices, and negative ions such as, $NO_x^{-}$ (nitrogen oxides where x=1 or 2). $O_3^{-}$ (ozone), and the like are often found in negative DC discharge. AC devices (dicorotrons) may also produce ions including $O^{-}$, $OH^{-}$, $O_2^{-}$, $NO_2^{-}$, $CO_3^{-}$, and the like. Of these, ozone and nitrogen oxides may occur in relatively large amounts and may be emitted into the surrounding atmosphere during the charging process as an effluent. These compounds are, generally highly reactive with organic compounds, such as morpholine, and/or the photoreceptor itself producing lateral charge migration (LCM) and/or parking deletion which negatively affect the photoreceptor and the resulting copy. Currently, fans and/or special coatings are used to remove or neutralize the gasses to various degrees of success.

Nitric oxide deletions or parking deletions have been a pervasive and persistent problem in these electrostatic copying systems. The name arises from the idea that when charging devices are run for a long period of time a relatively large amount of nitrogen oxides ($NO_x$) and ozone ($O_3$) build up. These effluents become adsorbed on the surface of nearby solids, and when the machine is shut down, the photoreceptor stops rotation and becomes "parked" with a small area directly adjacent to the charge device. Over a short period of time, the adsorbed effluents are released from the charge device in a process known as outgassing. Since the photoreceptor is parked in very close proximity to the charge device, a small local area of the photoreceptor becomes damaged and may produce an area of missing image leading to the deletion nomenclature.

Lateral charge migration (LCM) may involve the deposit of conductive salts formed through the interaction of corona and atmospheric contaminants, such as morpholine and organic nitrates, on a photoreceptor. These deposits may create a film on the photoreceptor which causes blurring of the electrostatic image or an uneven distribution of toner on the surface of the photoreceptor and, in some cases, deletions of portions of the image.

Photoreceptors have also been shown to be sensitive to nitric acid-type compounds such as, for example, $HNO_3$ and $HNO_2$ that may be emitted during the electrostatographic process. $HNO_3$ and $HNO_2$ are a combination of the $NO_x$ produced by the charge device and water vapor that is naturally present in the air as humidity. Nitric acids attack certain molecules in the transport layer of the photoreceptor rendering them over conductive. This increased conductivity allows any developed charge on the photoreceptor to leak to ground in the area of the attack or spread in what is sometimes, mistakenly, referred to as lateral charge migration, and areas of the image near the acid attack appear blank or, to a lesser extent, blurry because toner is not developed to the photoreceptor in these areas.

The disclosure contained herein described attempts to address one or more of the problems described above.

SUMMARY

Embodiments may generally be directed to a corona charging device having a housing, at least one corona generating electrode, and a coating covering at least a portion of the housing, the coating comprising an electrically conductive latex material having at least one antioxidant dispersed therein. In some embodiments, at least one effluent created by corona discharge may be absorbed by the coating, and in others, the corona may be able to withstand a corona discharge without significant deterioration of the appearance of the coating. The coating may have a conductivity of less than about 10,000 ohms per square, and in embodiments, the electrically conductive latex material may contain carbon black.

In certain embodiments, the latex material may be water soluble, and the antioxidant may be water soluble, or the latex material may be organically soluble and the antioxidant may be organically soluble. The antioxidant of embodiments may be at least one antioxidant selected from glutathione, ascorbate, uric acid, kaeferol, cynadin, polyphenols, polyphenolic acids, polyphenolic acid esters, alkylated phenols, 2,4-dimethyl-6-tert-butylphenol, 2,6-di-tert-butyl-4-methylphenol, butylated hydroxytoluene (BHT), butylated hydroxyanisole (BHA), ethylenediaminetetraacetic acid (EDTA), dimethylsulfoxide (DMSO), styrenated diphenylamines, zinc dialkyldithiophosphates, and/or para-styrenated diphenylamines. The antioxidant may be from about 0.5% to about 10% by volume of the total volume of the coating material in some embodiments and about 1% by volume in other embodiments. The coating may be from about 1 micron to about 50 microns thick.

The latex material, in embodiments, may further contain one or more components selected from binders, diluents, fillers, and additives, and additives may be pigments, dyes, catalysts, thickeners, stabilizers, emulsifiers, surfactants, texturizers, adhesion promoters, flatteners, deglossing agents, cross-linking agents, preservatives, flame retardants, dispersing agents, fixing agents, ancillary agents, anti-fading agents, anti-microbial agents, buffers, and combinations thereof. In some embodiments, the corona charging device may have an effluent absorbing coating other than the electrically conductive latex material.

Other embodiments are directed to a method for making a corona charging device including applying a coating comprising an electrically conductive latex material having at least one antioxidant dispersed within the latex material to a corona charging device. The coating may be applied as a solid, an aerosol, or a liquid and may be applied by method selected from spraying, brushing, rolling, dipping, melting, and/or pouring. In some embodiments, the corona charging device may be cleaned prior to applying the coating, and in others, a primer layer may be applied prior to applying the coating material. In still other embodiments, the corona charging device may be dried following applying the coating material.

DETAILED DESCRIPTION

Before the present methods, systems and materials are described, it is to be understood that this disclosure is not limited to the particular methodologies, systems and materials described, as these may vary. It is also be understood that the terminology used in the description is for the purpose of describing the particular versions or embodiments only, and is not intended to limit the scope. For example, as used herein and in the appended claims, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Embodiments described herein provide strategies employed to reduce the negative effects of effluents and include a coating for a charging device, such as, for example, a dicorotron, that may absorb effluents. The coating, of some embodiments, may be made up of a latex material and an antioxidant, and in other embodiments, an electrically conductive latex material and an antioxidant. In certain embodiments, the coating may absorb sufficient effluents so as to reduce or eliminate the negative effects of the effluent and may be capable of withstanding the discharge from the charging device while maintaining an acceptable appearance.

Embodiments may include a charging device coated with a coating made up of a latex material, that may be electrically conductive, and an antioxidant to make a "coated charging device", and other embodiments may include a method for coating a charging device with a coating made up of an electrically conductive latex material and an antioxidant.

A charging device may be made up of an operative arrangement of a housing and at least one corona generating device within the housing. Such a charging device may be coated with the electrically conductive latex/antioxidant coating on at least one portion of the housing. Any surface of the housing and/or corona generating device may be coated with the electrically conductive latex/antioxidant including, but not limited to the upper or lower surfaces of the housing or the surface facing the corona generating device or the surface facing away from the corona generating device, and in some embodiments, more than one surface of the housing may be coated. In some embodiments wherein the coated charging device may be included in a system for electrostatographic or xerographic printing, other components contained within the system may be coated with the, electrically conductive latex/antioxidant coating. For example, a fan, grating, toner cartridge, all or a portion of a housing for the entire system, or other housing within the system and the like and combinations thereof may be coated.

Figure 1:
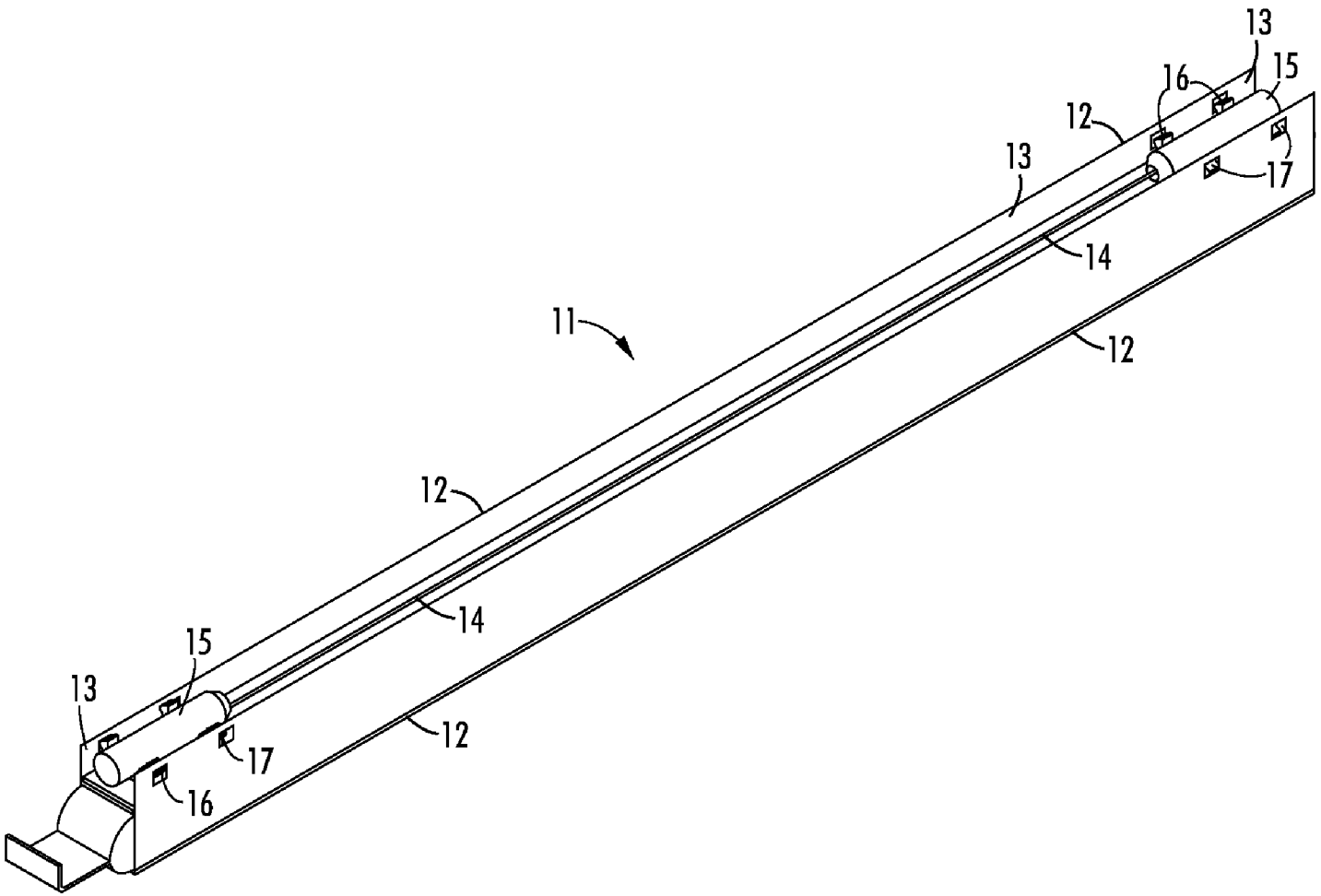
FIG. 1 PRIOR ART
FIG. 1 depicts a top perspective view of an uncoated corotron unit of the prior art.

In FIG. 1, a prior art dicorotron (corona) unit 11 is shown having a dicorotron housing 12 which is an elongated u-shaped housing. Inside this housing is a wire assembly made up of a wire electrode 14 attached at each end to anchors 15. Anchors 15 are removably attached to the housing 12 by grippers 16 that snap into housing apertures 17. In this embodiment, the open face 13 of the dicorotron unit 11 will be when in use, adjacent to the photoreceptor to be charged by wire electrode(s) 14.

Figure 2:
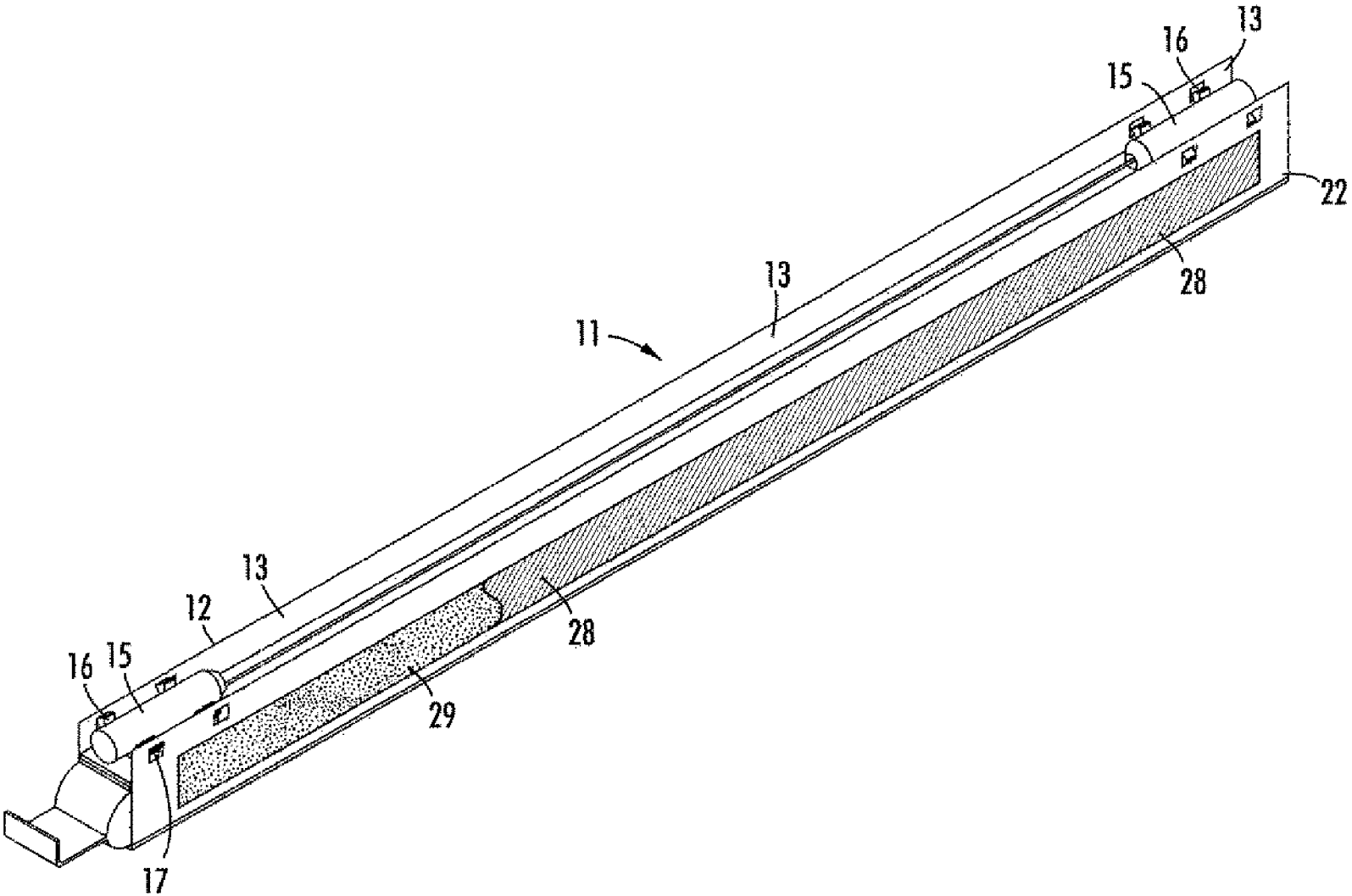
FIG. 2 depicts a top perspective view of a latex coated corotron unit.

In FIG. 2, the dicorotron unit 11 of FIG. 1 is plasma sprayed coated with a latex coating 28. This coating 28 may be on any portion(s) of housing 22. FIG. 2 shows this coating 28 on an outside portion of housing 22 for clarity only. Coatings on the interior of the housings are beneficial in that the coating is closer to the wire electrode 14, which causes the effluents to be formed. While the interior coating is more effective, the coating may be wherever it is suitable. In FIG. 2, a bond coat 29 may be applied to enhance adhesion of the latex coating 28 on the housing 22.

The latex material of the device may be a synthetic resin or a rubber latex, and in embodiments, synthetic resin or rubber latex may be made up of colloid particles suspended in water or an organic solvent to form a liquid dispersion that may be part of a paint, varnish, lacquer, glaze or other coating material. Latex materials, of embodiments, may harden when applied, and hardening may occur through drying by evaporation of the solvent or diluent in the latex material or by curing such as, the polymerization or cooling of the latex material. When dried or cured, the latex material may produce a network structure that is irreversibly bound. Synthetic resin latex materials may include, but not limited to, poly(vinyl chloride) latex, poly(vinylidene chloride) latex, polyurethane latex, polyacrylate latex, poly(vinyl acetate) latex, polyacrylonitrile latex, and modified products, copolymer and combinations thereof, and the rubber of rubber latexes may include, but not limited to, styrene butadiene rubber, acrylonitrile rubber, acrylonitrile butadiene rubber, isoprene isobutylene rubber, polyisobutylene, polybutadiene, polyisoprene, polychloroprene, polyethylene propylene, and combinations thereof.

These latex materials may be made electrically conductive, in embodiments of the invention, by any method known in the art, such as, for example, by the addition of carbon black to the latex material. In embodiments including an electrically conductive latex coating material, the conductivity of the latex coating may be less than about 10,000 ohms per square, and in some embodiments, the conductivity may be less than about 900 ohms per square.

Antioxidants, in embodiments of the invention, may be any component capable of reducing reactive oxidizing species. Without wishing to be bound by theory, the presence of antioxidants may reduce the level of reactive effluents in the area surrounding the charging device, as well as diminish potential oxidative damage to the charging device, electrostatographic or xerographic device or components therein, paint or combination thereof and reduce fading of the paint. Common antioxidants that may be used in embodiments of the present invention include, but are not limited to, glutathione, ascorbate, uric acid, kaemferol, cynadin, polyphenols, polyphenolic acids, polyphenolic acid esters, alkylated phenols, 2,4-dimethyl-6-tert-butylphenol, 2,6-di-tert-butyl-4-methylphenol, butylated hydroxytoluene (BHT), butylated hydroxyanisole (BHA), ethylenediaminetetraacetic acid (EDTA), dimethylsulfoxide (DMSO), sytrenated diphenylamines, para-styrenated diphenylamines, zinc dialkyldithiophosphates, and the like. In particular embodiments, commercially available antioxidants may be used such as Aquanox 29, Wingstay 29 and the like. Free radical scavengers may also be used as an antioxidant in embodiments of the invention.

In certain embodiments, a water soluble antioxidant may be dissolved in an aqueous latex material. Without wishing to be bound by theory, water soluble antioxidants dissolved in aqueous latex materials may be more effective than organically soluble antioxidants since the antioxidant may be more uniformly distributed throughout the latex material and/or antioxidant, in embodiments, may be from about 0.5% to about 10% of the total volume of the electrically conductive latex/antioxidant coating and, in other embodiments from 0.5% to about 5% of the total volume. In certain embodiments, the antioxidant is about 1% of the electrically conductive latex/antioxidant coating.

The electrically conductive latex/antioxidant coating material may also contain other components known to be useful in such materials, such as, for example, one or more binder, diluent, filler, additive, and the like or combinations thereof.

Binders may be any material that when added to the latex material allows colloid particles of latex within the latex material to become bound together or cross-linked when the coating material is dried or cured. Common binders include, but are not limited to, synthetic or natural resins such as, acrylics, polyurethanes, polyesters, melamines, epoxies, oils, and the like and combinations thereof. Binders may be added at concentrations known to those skilled in the art that may impart desired properties to the latex material.

Diluents, of embodiments, may be any material in which the latex material of the electrically conductive latex/antioxidant coating may be dissolved, such as, for example, water or organic materials such as, petroleum distillates, alcohols, ketones, esters, glycol ethers, and the like and combinations thereof. Diluents may be added to the latex material at concentrations known in the art to provide an electrically conductive latex/antioxidant coating that is of the desired consistency.

Fillers may be added to electrically conductive latex/antioxidant coatings of the invention to thicken, support the latex structure, increase the volume of the coating material or combinations thereof. Fillers may be essentially transparent or opaque and may be colored or neutrally colored. Fillers that may be used in embodiments may include, but are not limited to, talc, lime, barite, bentonite clay, and the like and combinations thereof and may be added to the latex material at concentrations known to those of ordinary skill in the art to impart the desired thickness.

Additives may be added to embodiments to provide the latex material with necessary properties for the use of the latex material. Non-limiting examples of additives include: pigments, dyes, catalysts, thickeners, stabilizers, emulsifiers, surfactants, texturizers, adhesion promoters, flatteners, deglossing agents, cross-linking agent, preservatives, flame retardants, dispersing agents, fixing agents, ancillary agents, anti-fading agents, anti-microbial agents, buffers, and the like. Additives may be added at various concentrations depending on the additive and the desired effect.

The housing, of a charging device of embodiments, may be made from any material, and in certain embodiments, may be made of a metal, such as, for example, aluminum. In some embodiments, the surface to be coated may be treated with another coating, such as, $TiO_2$, that may also absorb effluents, or a coating that allows the electrically conductive latex/antioxidant coating to more effectively adhere to the surface to be coated, or provide a more acceptable finish such as, a primer or binder layer.

Figure 3:
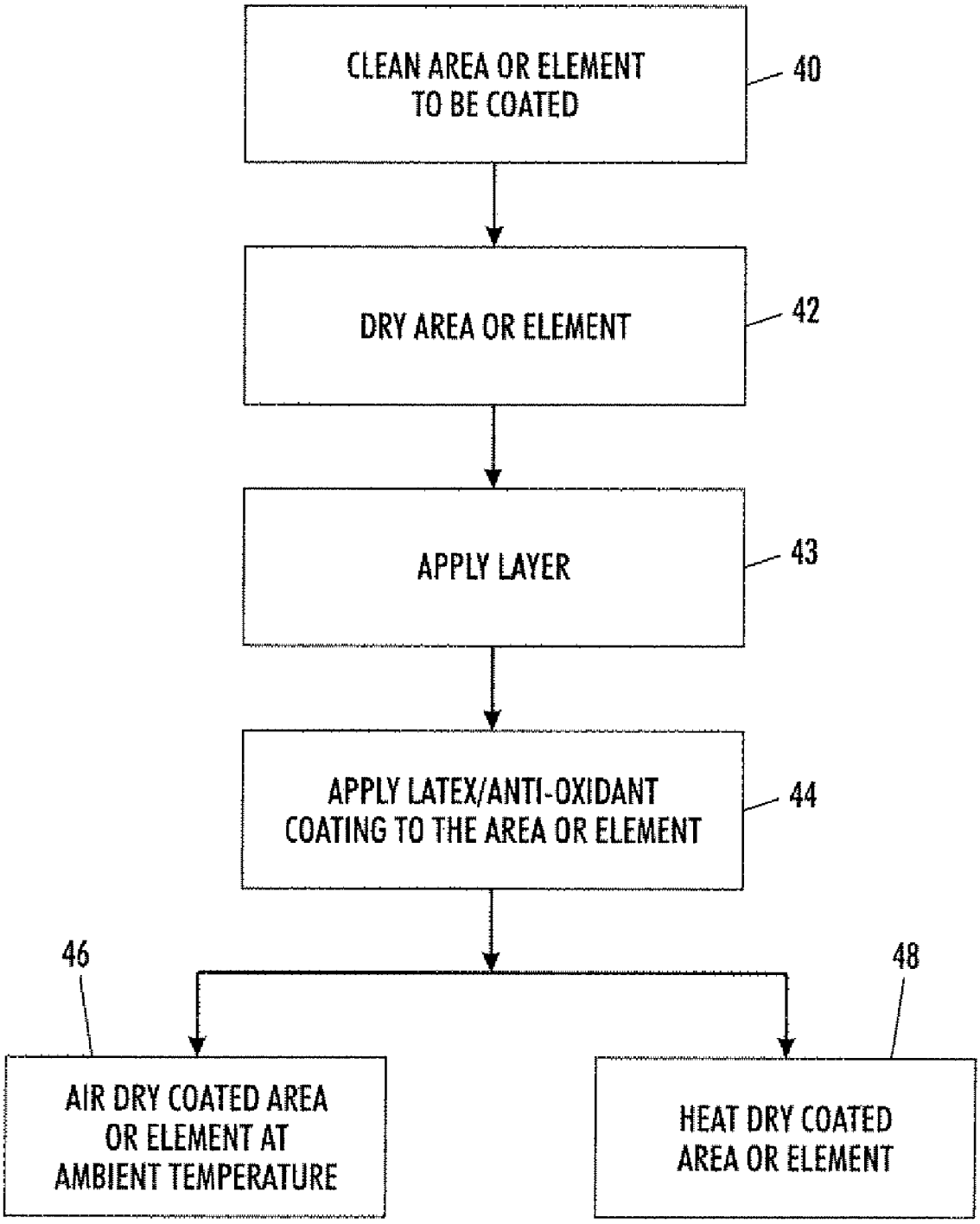
FIG. 3 depicts a flow diagram of a process for making a coated corona charging device.

Embodiments of methods for coating a corona charging device are provided in the flow chart of FIG. 3. The steps provided in FIG. 3 are as follows: clean the area or element to be coated 40, dry the area or element to be coated 42, prime the area or element to be coated 43, apply the electrically conductive latex/antioxidant coating to the area or element 44, the electrically conductive latex/antioxidant coating may be dried at ambient temperature 46 or by heat drying 48.

In embodiments, the housing or other component to which the latex material will be applied may be cleaned prior to the application of the latex material 40. Any method known in the art that may be used to clean the housing including, but not limited to, washing with a detergent, washing with solvent, heating the material, or using an ultrasonic degreaser. Without wishing to be bound by theory, this may allow the latex material to bind to the housing more readily, and/or may allow for a better finish.

Following the cleaning of the area or element, the area or element may be dried 42 using any method known in the art. In some embodiments, drying may include drying at ambient temperature or heat drying as described below. In certain embodiments, drying the area or element may further include washing the area or element with a solvent. Without wishing to be bound by theory, washing with an organic solvent may remove residual solvent from cleaning or production of the element or area.

In certain embodiments, the area or elements to be coated may be primed prior to the application of the electrically conductive latex/antioxidant coating 43. In some embodiment, priming may include, coating the area or element with a liquid primer which may allow the electrically conductive latex/antioxidant coating to adhere to the surface of the element more readily. Liquid primers are well known in the art and may be applied using the same or similar methods used to apply the electrically conductive latex/antioxidant coating. Following the application of liquid primers, the primer layer may be dried at either ambient temperature or by heat drying. In other embodiments, priming the area or element may include roughing or scratching the surface of the area or element. Without wishing to be bound by theory, scratching the surface of the area or element may provide grooves into which the electrically conductive latex/antioxidant coating may flow allowing the electrically conductive latex/antioxidant coating to bind directly to the surface of the area or element. In still other embodiments, a combination of scratching or roughing the surface and applying a liquid primer may be used.

The electrically conductive latex/antioxidant coating of embodiments may be applied to a surface using any method known in the art 44, for example, the coating may be applied as a solid, a gaseous suspension such as an aerosol, or a liquid. When a method for solid application is used, particles of the latex coating material are applied to the surface of the housing and the housing is heated. Upon heating, the particles melt irreversibly binding them to the surface of the housing. Gaseous suspensions of the latex material may be applied by spraying the material onto the surface of the housing, and liquid latex materials may be applied using any method known in the art including, but not limited to, brushing, rolling, using blades, dripping, pouring or dipping. The finish may be smooth or ridged, and in certain embodiments the coating may be applied so as to provide a porous finish. Without wishing to be bound by theory, pores within the coating may allow for greater antioxidant containing surface area and, thus, improved absorption of effluents.

The latex coating may be applied to a thickness of at least about 25 microns and, in some embodiments, from about 1 to about 50 microns thick. In embodiments where the electrically conductive latex/antioxidant coating is applied in such a way as to provide a texture finish either through the addition of a texturizer or by applying the coating in such a way as to provide pores or ridges, the coating may be applied to a thickness greater than about 25 microns.

Following the application of the gaseous or liquid latex material the coating may be dried or cured by any method known in the art such as, air drying 46, heat drying 47 and the like. Air drying may occur at ambient temperature and, in some embodiments, may require at least about 12 hours to fully cure. In embodiments including heat drying, the latex material may be cured at from about 42° C. to about 200° C. or, in certain embodiments, from about 100° C. to about 150° C. The time required for complete drying or curing may vary depending on the temperature, thickness and/or consistency of the coating and may be at least about 20 minutes to more than about 60 minutes.

In some embodiments, the latex material may be removed from the housing or other component to which it has been applied after its effective life time has expired and replaced with another coating. The latex material may be removed using any method known in the art such as, for example; heating; applying chemicals; physically means, such as scraping, stripping, pealing, scrubbing, and sanding; and the like and combinations thereof. The latex material may then be reapplied as described above.

EXAMPLE

Several coatings were applied to a fixture designed to gauge the effect of materials of photoreceptors, and underwent several rounds of charging. The average deletion was calculated and the data was averaged over four separate runs. The data is provided in FIG. 4.

Figure 4:
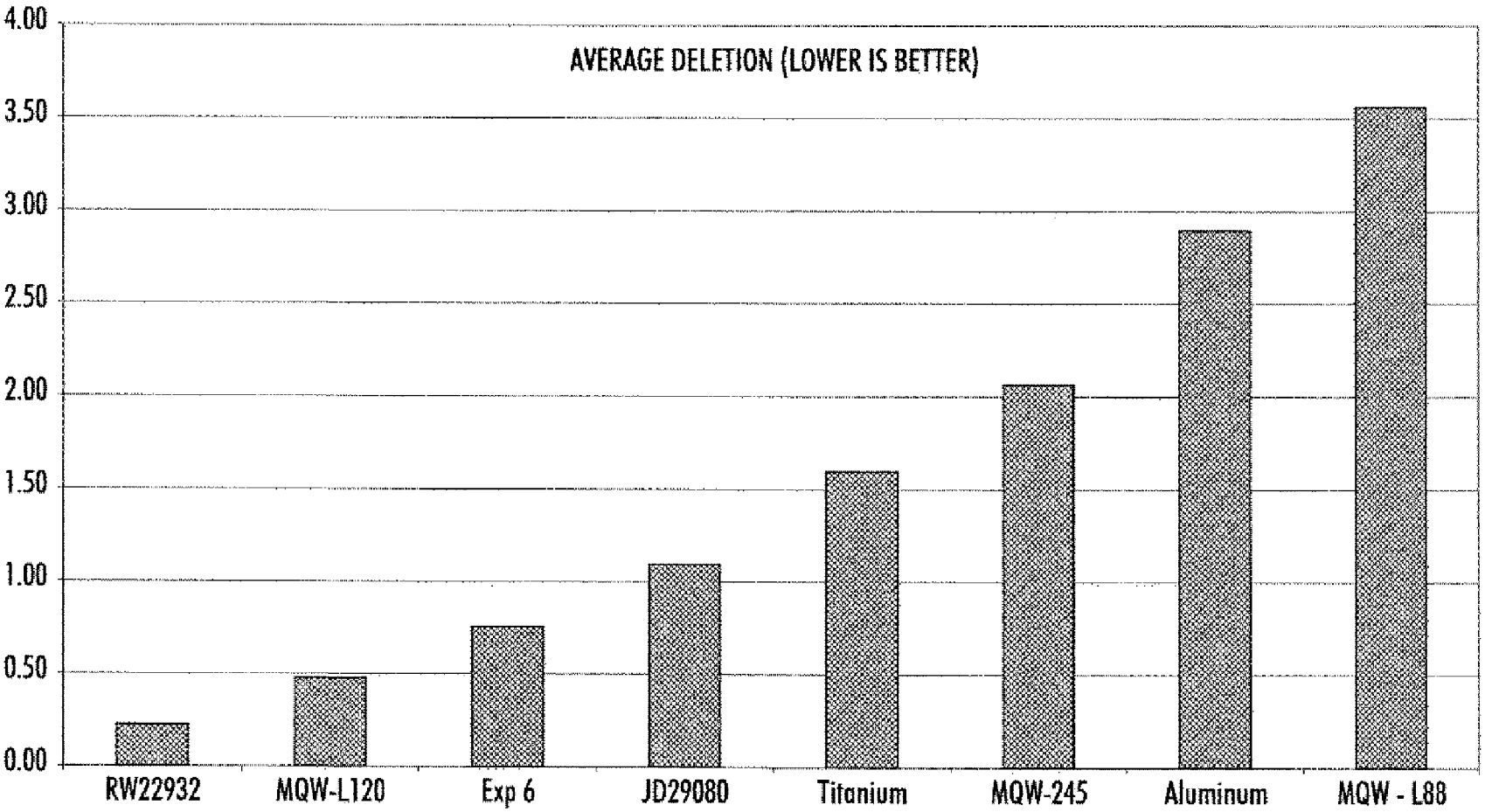
FIG. 4 is a bar graph depicting the average deletion of several corona charging devices.

FIG. 4 shows that Exp 6, which is an electrically conductive latex paint (MQW 245) with and antioxidant (Aquanox 29), may reduce the average deletion compared to the latex paint itself (MCW 245) or other methods for reducing the average deletion such as titanium and aluminum, and produces a similar average deletion to materials containing nickel (JD29080) and MQW 245 containing nickel (MQW-L120) and the current coating for some charge devices RW22932. In addition to a reduction in the average deletion, Exp 6 also maintained its appearance better than the other coating materials.

It will be appreciated that various of the above-disclosed and other features and functions, or alternatives thereof, may be desirably combined into many other different systems or applications. Also that various presently unforeseen or unanticipated alternatives, modifications, variations or improvements may be subsequently made by those skilled in the art which are also intended to be encompassed by the following claims.

What is claimed is:

1. A corona charging device comprising:

a housing;

at least one corona generating electrode; and a porous coating covering at least a portion of the housing, the coating comprising a primer Layer and a latex layer, wherein the latex layer comprises an electrically conductive latex material having at least one phenolic antioxidant dispersed therein.

2. The corona charging device of claim 1, wherein the coating withstands a corona discharge without significant deterioration of the appearance of the coating.

3. The corona charging device of claim 1, wherein the at least one antioxidant is from about 0.5% to about 10% by volume of the total volume of the latex layer.

4. The corona charging device of claim 1, wherein the antioxidant is about 1% by volume of the total volume of the latex layer.

5. The corona charging device of claim 1, wherein the latex material is water soluble and the antioxidant is water soluble.

6. The corona charging device of claim 1, wherein the latex material is organically soluble and the antioxidant is organically soluble.

7. The corona charging device of claims 1, wherein the coating is from about 1micron to about 50 microns thick.

8. The corona charging device of claim 1, wherein the primer layer covers an interior portion of the housing.

9. The corona charging device of claim 1, wherein the phenolic antioxidant is uniformly dispersed throughout the conductive latex material.

10. The corona charging device of claim 1, further comprising an absorbing layer.

11. The corona charging device of claim 10, wherein the coating comprises carbon black and has a conductivity of less than about 10,000 ohms per square.

12. The corona charging device of claim 11, wherein the at least one phenolic antioxidant comprises an antioxidant selected from the group consisting of kaemferol, cynadin, polyphenols, polyphenolic acids, polyphenolic acid esters, alkylated phenols, 2,4-dimethyl-6-tert-butylphenol, 2,6-di-tert-butyl-4-methylphenol, butylated hydroxytoluene (BHT), butylated hydroxyanisole (BHA), styrenated diphenylamines and para-styrenated diphenylamines.

13. The corona charging device of claim 12, further comprising at least one antioxidant selected from the group consisting of glutathione, ascorbate, uric acid, ethylenediaminetetraacetic acid (EDTA), dimethylsulfoxide (DMSO), and zinc dialkyldithiophosphates.

14. The corona charging device of claim 12, wherein the latex material further comprises one or more components selected from the groups consisting of binders, diluents, fillers, and additives.

15. The corona charging device of claim 14, wherein the additive is selected from the group consisting of pigments, dyes, catalysts, thickeners, stabilizers, emulsifiers, surfactants, texturizers, adhesion promoters, flatteners, deglossing agents, cross-linking agent, preservatives, flame retardants, dispersing agents, fixing agents, ancillary agents, anti-fading agents, anti-microbial agents, buffers, and combinations thereof.

16. A method for making a corona charging device comprising:

applying a primer layer to a corona charging device;

applying a first coating comprising an effluent absorbing material; and applying a second coating comprising an electrically conductive latex material having at least one phenolic antioxidant dispersed within the latex material to at least an interior portion of the corona charging device so as to provide a porous finish.

17. The method of claim 16, wherein the second coating is applied as a solid, an aerosol, or a liquid.

18. The method of claim 16, wherein the second coating is applied by a method selected from the group consisting of spraying, brushing, rolling, dipping, melting and pouring.

19. The method of claim 16, further comprising cleaning the corona charging device prior to applying the first and second coatings.

20. The method of claim 16, further comprising drying the corona charging device after the applying of the coatings.

21. The method of claim 16, wherein the application of the second coating comprising the electrically conductive latex material having at least one phenolic antioxidant dispersed within the latex material to at least the interior portion of the corona charging device is reversible.

* * * * *